US005864304A

United States Patent [19]

Gerszberg et al.

[11] Patent Number: 5,864,304

[45] Date of Patent: Jan. 26, 1999

[54] WIRELESS RAILROAD GRADE CROSSING WARNING SYSTEM

[75] Inventors: Irwin Gerszberg, Kendall Park; Thomas T. Shen, East Hanover, both of N.J.

[73] Assignee: AT&T Corp, Middletown, N.J.

[21] Appl. No.: 694,378

[22] Filed: Aug. 8, 1996

[51] Int. Cl.[6] ..... G08G 1/16

[52] U.S. Cl. ..... 340/903; 340/901; 340/905; 49/25; 246/122 R; 246/125; 246/126; 246/187 B; 246/473.1; 246/473.2

[58] Field of Search ..... 340/903, 907, 340/902, 905, 901, 989, 994; 49/25, 49; 246/473.1, 473.2, 473.3, 122 R, 187 B, 293, 125, 126, 127, 5, 7

[56] References Cited

U.S. PATENT DOCUMENTS

| | | | |
|---|---|---|---|
| 1,882,265 | 10/1932 | Vallee | 246/473.2 |
| 2,137,719 | 11/1938 | Gray et al. | 340/901 |
| 3,758,775 | 9/1973 | Hopkins | 246/125 |
| 3,888,437 | 6/1975 | Birkin | 246/122 R |
| 4,788,498 | 11/1988 | Uemura | 246/187 B |
| 4,887,205 | 12/1989 | Chou | 49/25 |
| 4,931,793 | 6/1990 | Fuhrmann et al. | 246/473.1 |
| 5,092,544 | 3/1992 | Petit et al. | 246/126 |
| 5,196,846 | 3/1993 | Brockelsby et al. | 340/905 |
| 5,554,982 | 9/1996 | Shirkey et al. | 340/903 |

*Primary Examiner*—Jeffery A. Hofsass
*Assistant Examiner*—John Tweel, Jr.

[57] ABSTRACT

A railroad-crossing warning system for protecting pedestrians and motorists from an oncoming train. The warning system has a vehicle detector system for determining whether a vehicle is stuck in an area of the railroad crossing, a train detector system for determining vital train information including the speed and direction of the oncoming train, a display unit for displaying warning messages to the pedestrians and motorists approaching the railroad crossing, and a communication system for communicating the vital train information and the distressed vehicle information to the oncoming train and the display system. The system provides early warning to the operator of the oncoming train to provide more reliable protection for distressed vehicles in the railroad crossing and for motorists and pedestrians approaching the railroad crossing.

13 Claims, 4 Drawing Sheets

WIRELESS RAILROAD GRADE CROSSING WARNING SYSTEM

FIELD OF THE INVENTION

This invention relates to warning systems, and more particularly to railroad-crossing warning systems.

BACKGROUND OF THE INVENTION

Heretofore, railroad-crossing warning systems use pole lines connected to trackside devices to communicate vital train information to passing motorists and pedestrians. That is, present day railroad warning systems use pole lines to transmit a signal to a flashing light and a retractable gate to warn pedestrians and motorists that a train is approaching the railroad crossing.

The high cost of constructing and maintaining these systems as well as their susceptibility to adverse weather conditions and their unappealing effect on the surrounding scenery, however, have made such present day systems less than desirable. In addition, due to the high number of railroad crossing accidents each year, such present day systems are not reliable for providing safety to such motorists and pedestrians.

One solution to this problem was disclosed in U.S. Pat. No. 4,942,395 issued on Jul. 17, 1990, to Ferrari, et. al. (hereinafter Ferrari '395) and incorporated herein by reference. Ferrari '395 discloses a wireless warning system that provides warning of an oncoming train to motorists traveling within a given proximity of the railroad crossing. Basically, the Ferrari '395 warning system uses a three-transceiver system, wherein the oncoming train has a mounted transceiver that constantly sends a warning radio signal to a transceiver unit, located on a pole at the railroad crossing, which, in turn, sends a warning signal to a transceiver unit located within the vehicle of each motorist. That is, the Ferrari '395 warning system focus' solely on warning passing motorists who have a transceiver installed in their vehicle, wherein the transceiver is equipped with a display for visually alerting the motorist of an oncoming train.

Although the Ferrari '395 warning system provides a means of communicating warning information to motorists crossing the path of an oncoming train, the Ferrari '395 system fails to consider the safety of pedestrians and those motorists that do not have an automobile with such a transceiver installed. In addition, Ferrari '395 fails to provide a means for protecting those motorists stuck in the crossing in the path of an approaching train. Moreover, Ferrari '395 does not address the warning standards of present day non-wireless warning systems (i.e. 20 second minimum warning time). As a result, the Ferrari '395 system fails to protect those motorists stuck in the path of a train that can not stop before it enters the crossing. Since a fully loaded train can take over 1.5 minutes to come to a complete stop, such motorists stuck in the intersection have no protection under both present day warning systems as well as the system disclosed in Ferrari '395.

In addition, in present day systems, there are times when there is no train approaching a crossing where the warning lights are flashing and the gates are down blocking the road. Yet, there are times when the gates and flashing lights are non-functional as a train approaches the crossing. In such situations, present day systems do not provide an auxiliary or backup measure to protect motorists and pedestrians approaching or those stuck in the crossing area.

SUMMARY OF THE INVENTION

Accordingly, the present invention is directed to a highly reliable warning system that can provide both primary and auxiliary protection for motorists and pedestrians crossing a railroad crossing in the path of an approaching train. To attain this, the present invention provides a vehicle detector system for detecting the presence of vehicles in the path of the oncoming train in the railroad crossing, a train detector system for detecting vital train information (e.g. the presence, speed and direction of the oncoming train), a display unit for notifying crossing traffic of the oncoming train's vital information, and a communications system for communicating to the oncoming train the presence of any distressed vehicle in the railroad crossing.

In one embodiment of the invention, the vehicle detector system has six magnetic sensor probes that cover a 40×40 foot area in the railroad crossing for detecting the presence of any vehicles in the railroad crossing to determine distressed vehicle warning information therefore. The train detector system has a series of trackside devices equally spaced along the length of the railroad track for detecting the presence of the oncoming train at a specified location and time to determine the vital warning information for the oncoming train. The train warning information and vehicle warning information are transmitted to a two-sided light emitting diode (LED) display located at the railroad crossing over a wireless communications system. In addition, the wireless communications system communicates the vehicle warning information to the oncoming train.

As a result, the warning system of the present invention provides early warning (e.g. 90 seconds prior to reaching the railroad crossing) of a distressed vehicle to the oncoming, thus giving the train operator time to safely stop the train before entering the railroad crossing and injuring the occupants of the distressed vehicle. In addition, the warning system of the present invention provides detailed vital train information to traffic crossing at the railroad crossing, thus increasing pedestrian and motorist protection from the oncoming trains.

These and other features of the invention are described in more detail in the following detailed description of the embodiments of the invention when taken with the drawings. The scope of the invention, however, is limited only by the claims appended hereto.

DETAILED DESCRIPTION OF ILLUSTRATIVE EMBODIMENTS OF THE INVENTION

Figure 1:
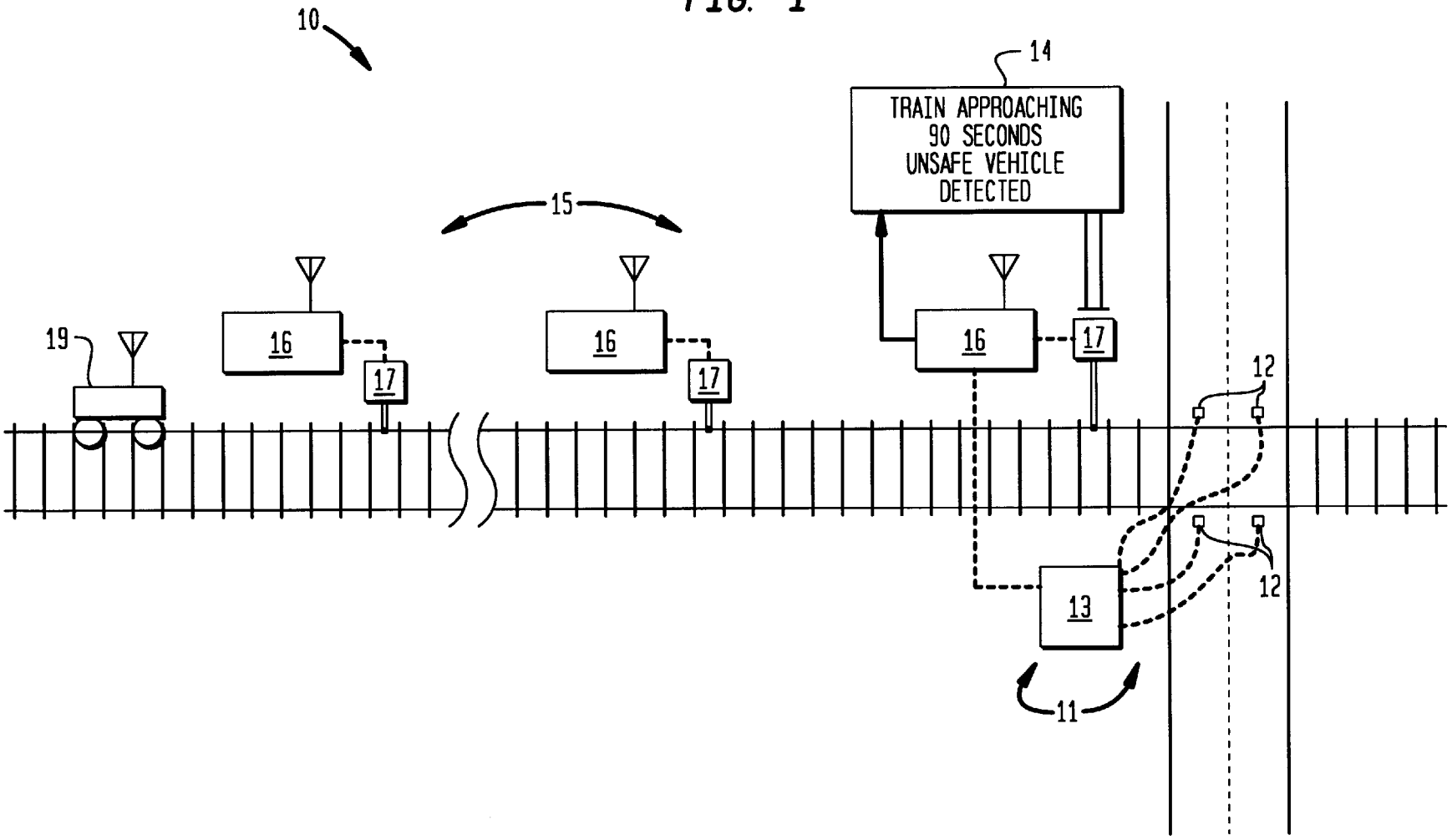
FIG. 1 is a pictorial view of one embodiment of the warning system according to the present invention.

Referring now to FIG. 1, there is shown one embodiment of a warning system according to the present invention, hereinafter referred to as warning system 10. As shown, warning system 10 has a vehicle detection system 11, a display unit 14, a train detector system 17, and a wireless communications system 15. Wireless communications system 15 can provide communications of railway activity for locomotives or trains traveling along either direction along the railway (i.e. both sides of the railroad crossing).

Train detector system 17 is composed of a plurality detector circuits positioned at predetermined locations along the length of the railroad track. Wireless communications system 15 has a plurality of trackside devices 16 positioned at predetermined locations along the track, wherein each trackside device 16 is coupled to a detector circuit of detector system 17. Vehicle detection system 11 has a plurality of sensor probes 12 coupled to a control box 13 which, in turn, is coupled to a predetermined trackside device 16 of wireless communications system 15. The display unit 14 is also coupled to a predetermined trackside device 16 of wireless communications system 15.

In operation, vehicle detection system 11 detects the presence of vehicles in the railroad crossing through sensor probes 12. That is, sensor probes 12 use a metal detection technique (e.g. a magnetic field) to determine if and how long a vehicle is present in the railroad crossing. From this, vehicle detection system 11 decides whether to alert the oncoming train 19 of a distressed vehicle in its path, and whether to alert the pedestrian and motorist traffic crossing the railroad of the distressed vehicle.

If vehicle detection system 11 decides to send these warnings, distressed vehicle alert information is sent to a trackside device 16 of wireless communications system 15. Trackside device 16 then employs a fast message hopping means for transmitting said distressed vehicle information to display unit 14 and any oncoming train 19. The fast message hopping means can be any means for wireless communications between trackside devices 16 of communications system 15. When the distressed vehicle information reaches display unit 14, a message is displayed thereon to alert traffic crossing the railroad tracks of the distressed vehicle. Similarly, when the distressed vehicle information reaches oncoming train 19, the train operator is alerted that a distressed vehicle is present in the railroad crossing ahead.

Due to the constant monitoring of the railroad crossing, a distressed vehicle can be identified and the oncoming train can be immediately alerted when a distressed vehicle is present in the railroad crossing. As a result, an oncoming train can receive an early warning (e.g. 90 seconds before the train enters the railroad crossing) of such a distressed vehicle, and thus be provided enough time to stop the train before it enters the intersection. Thus, overcoming a limitation of prior art warning systems wherein only a 20 second advanced warning is provided to a traffic approaching a railroad crossing in the path of a train that actually requires up to 90 seconds to come to a complete stop.

Train detector system 17 utilizes a plurality of detector circuits spaced at predetermined locations along the track to detect vital information of an oncoming train (e.g. speed and direction). This vital train warning information is then sent to a trackside device 16 which communicates the information on wireless communications system 15 to display unit 14 at the railroad crossing. Display unit 14 then displays a message to warn traffic at the railroad crossing of the oncoming train. Such display messages include a train approaching message, a train direction message, and a train approaching time message.

Figure 2:
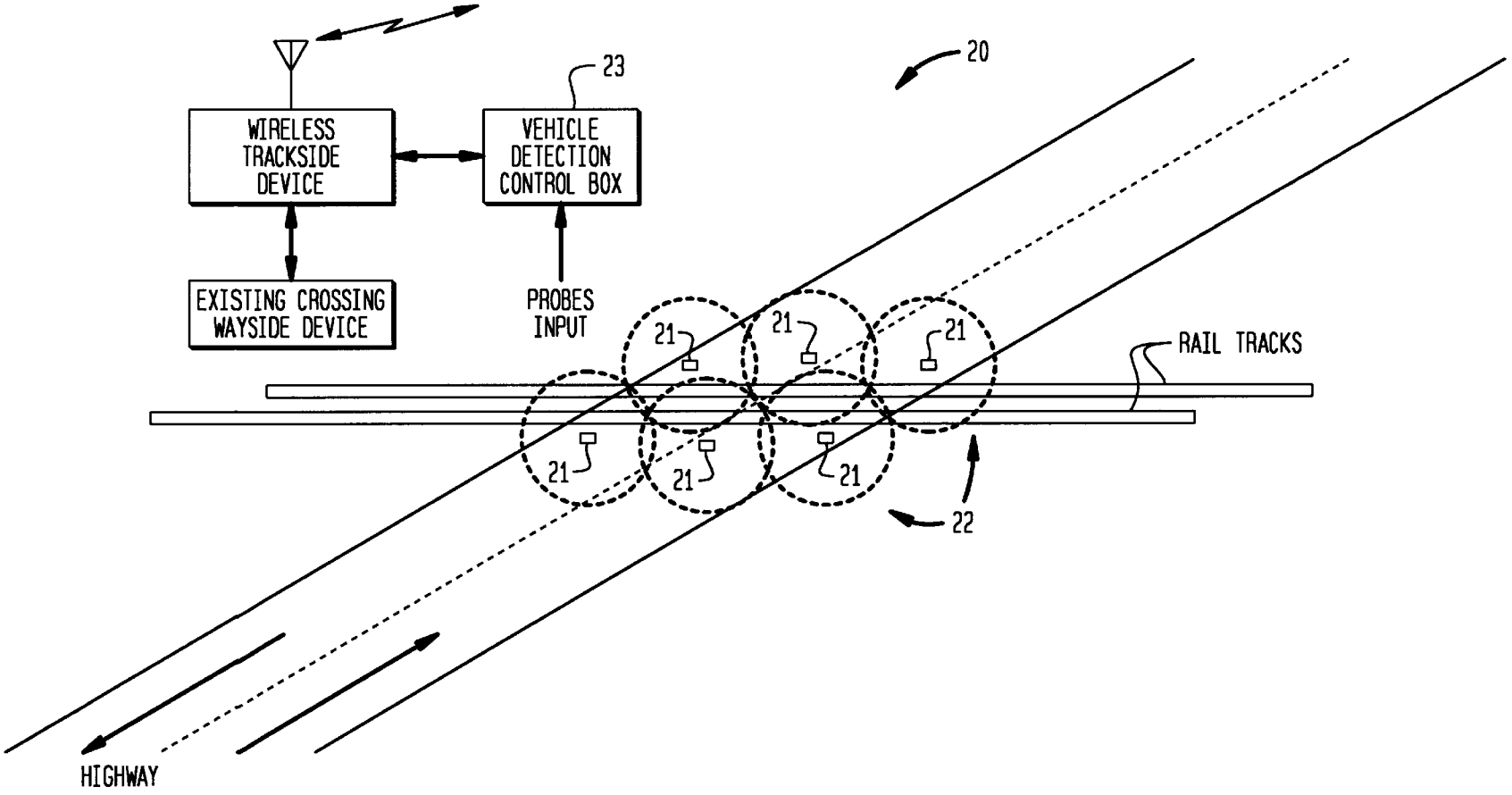
FIG. 2 is a pictorial view of one embodiment of the vehicle detector system shown in FIG. 1.

FIG. 2 shows one embodiment of a vehicle detector system 20 as described above in warning system 10. As shown, vehicle detector system 20 has six buried sensor probes 21 that cover a detection coverage area 22 of the railroad crossing. Sensor probes 21 are all coupled to vehicle detection control box or control box 23. As described above, sensor probes 21 alert control box 23 as to whether a vehicle is present in coverage area 22, the length of time the vehicle is present therein and the approximate position of the vehicle in coverage area 22. From this information, control box 23 can decide whether to send warning information to both an oncoming train and a display unit located at the railroad crossing.

In one embodiment of the invention, each sensor probe 21 outputs a signal that represents a metal sensing level. To offset for any detection of the metal tracks of the railway, however, the signal from each sensor probe 21 is compared to a threshold sensing level under which control box 23 reports no vehicle presence. As a result, to determine whether a vehicle is present and in-distress in the railroad crossing, control box 23 monitors the signals from sensor probes 21 and counts the duration over which a vehicle is detected in the railroad crossing. Once a vehicle is detected present for a predetermined duration and/or during an approach of an oncoming train, a vehicle detection alarm is generated.

In one method of generating a vehicle detection alarm, control box 23 may employ a dynamic adjustment duration method, wherein the duration may vary from 2 to 10 seconds depending on the presence or absence of an approaching train. For example, given a calculated approaching train time of 100 seconds or more (i.e. 100 seconds before the train enters the railroad crossing at its present speed), the minimum duration of vehicle detection can be set to 10 seconds after which control box 23 generates a vehicle detection alarm. Similarly, given a calculated approach time between 20 and 100 seconds, the duration of vehicle detection can be set to 4 seconds after which the alarm is generated. And, given an approach time of less than 20 seconds, the duration can be set to 2 seconds. Such a dynamic adjustment of the detection time, before an alarm is generated, enables detector system 20 to provide a predetermined safety level, reduced false alarms, and increased efficiency of the crossing traffic.

Figure 3:
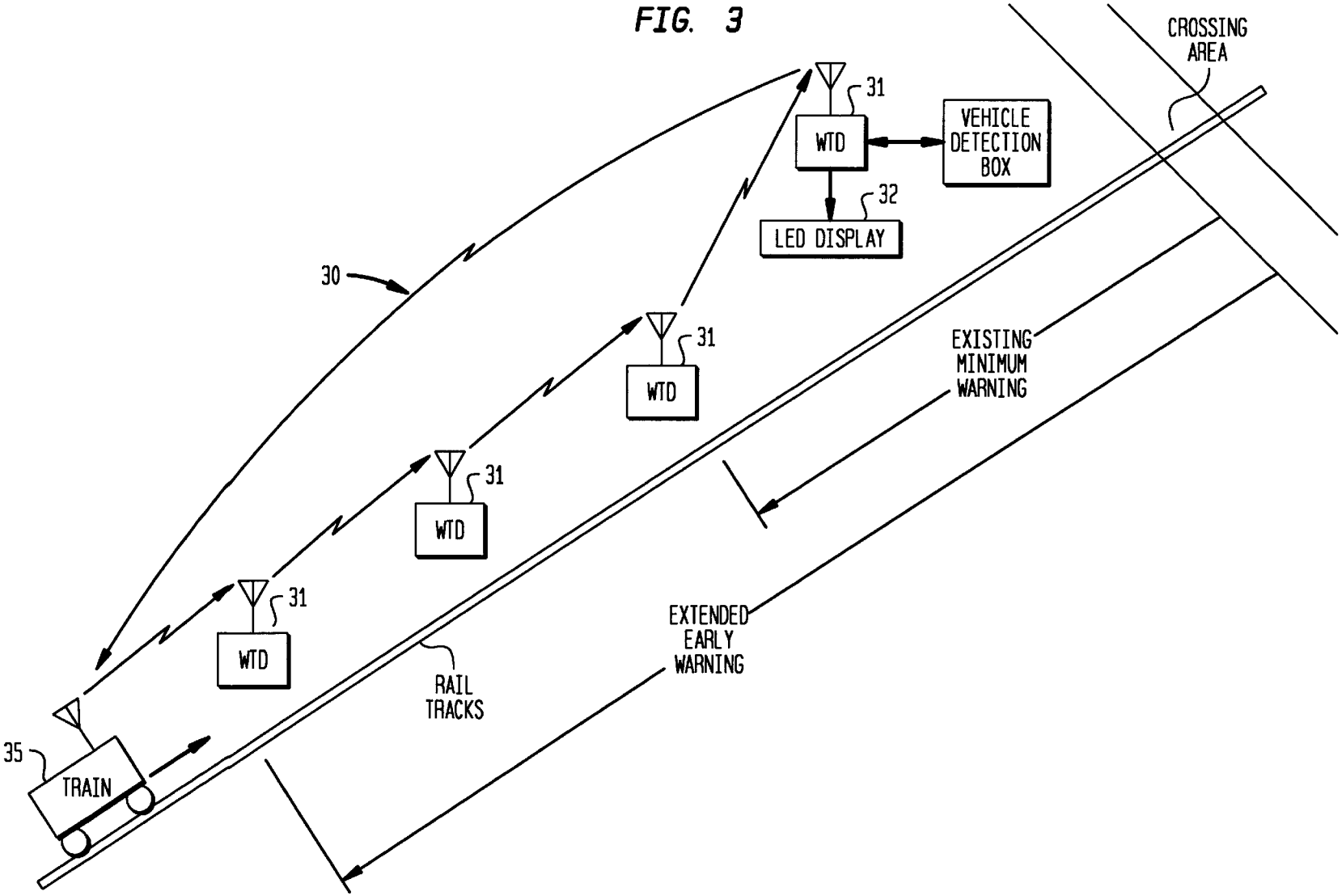
FIG. 3 is a pictorial view of one embodiment of the communications system shown in FIG. 1.

One embodiment of a wireless communications system 30 as described in system 10 is shown in FIG. 3. As shown, wireless communications system 30 has a plurality of wireless trackside devices (WTDs) 31 positioned at predetermined locations along the railroad track. WTDs 31 communicate warning information (e.g. vital train information and distressed vehicle information) between each other and display unit 32 located at the railroad crossing. As oncoming train 35 travels along the railroad tracks, WTDs 31 determine and communicate the vital train information (e.g. direction and speed) of oncoming train 35 to display unit 32. In one method of determining the train speed, each WTD 31 detects the presence of train 35 at its location along the track, notes the actual time of that detection, sends that detection information to adjacent WTDs 31 which note the time in which train 35 is detected at their respective locations, compares the time difference between these detections, and divides that time difference into the known distance between the WTDs making the detections to determine the train speed therebetween. As described above, the train speed along with any other warning information is communicated to display unit 32 which generates warning messages to the crossing traffic. In one method of estimating the train approaching time, the crossing WTD receives the fast hopping message from the WTD which the train is currently passing by, notes the given distance between the two WTDs, and divides the distance by the train speed.

Figure 4:
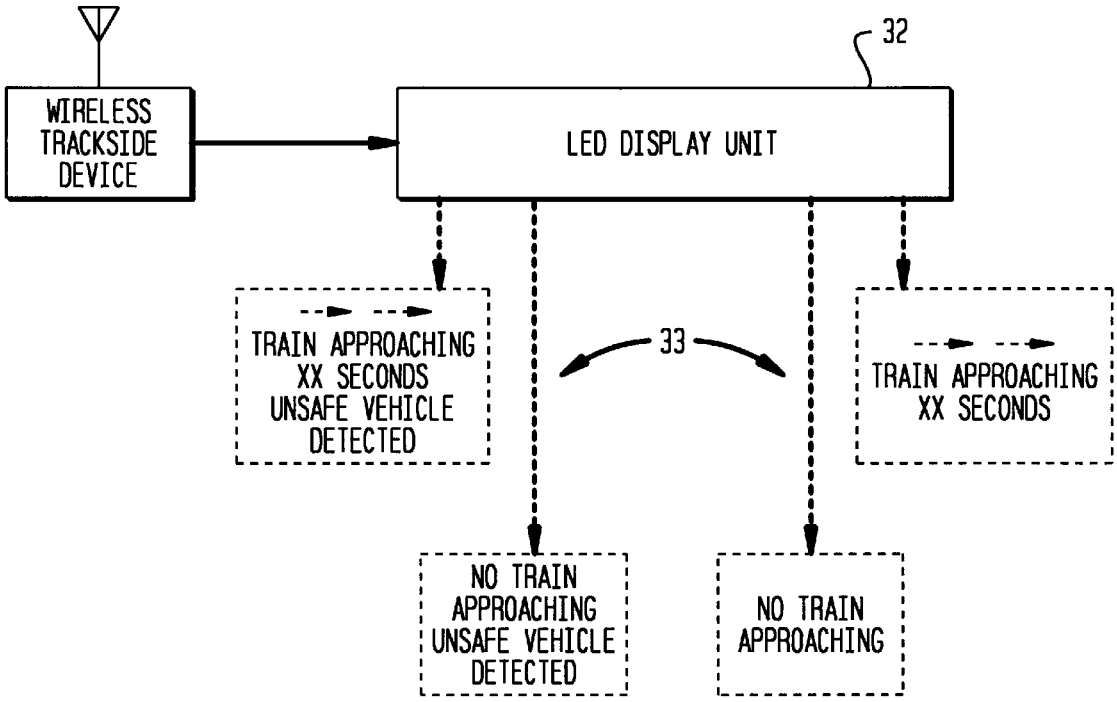
FIG. 4 is a diagrammatic view of one embodiment of the display unit shown in FIG. 3.

One embodiment of display unit 32 is shown in FIG. 4. As shown, display unit 32 is a two-sided light emitting diode (LED) display that can display a set of warning messages 33 as required by the warning system. Warning messages 33 include a train approaching message, an approaching time message, an unsafe vehicle detected message, a no train approaching message, and an unsafe vehicle detected message. Display unit 32 can be located beside the flashing light and/or the closing gate of present day warning systems on each side of the tracks to draw the attention of approaching motorists and pedestrians. Thus, the warning system of the present invention can also serve as an auxiliary warning system to present day systems as well as a primary warning system to protect pedestrians and motorists from approaching trains.

The above description includes exemplary embodiments and methods of implementing the present invention. References to specific examples and embodiments in the description should not be construed to limit the present invention in any manner, and is merely provided for the purpose of describing the general principles of the present invention. It will be apparent to one of ordinary skill in the art that the present invention may be practiced through other embodiments.

What is claimed is:

1. A railroad crossing warning system for protecting traffic from an approaching train, comprising:

a wireless trackside communications system for bidirectionally communicating critical railway and traffic control data, between a vehicle at a railroad crossing and a train approaching the railroad crossing, said wireless trackside communications system having a plurality of trackside devices for detecting the presence, location, speed and direction of the approaching train to determine train warning information, said plurality of trackside devices communicating said train warning information between each other;

a vehicle detector system operating independently of any onboard vehicle systems, the vehicle detector located at the railroad crossing for detecting a presence of a vehicle in an area of the railroad crossing; said vehicle detector system coupled to a given trackside device of said wireless communications system such that said distressed vehicle warning information is communicated thereon; and a display unit located at the railroad crossing for displaying said oncoming train warning information and said distressed vehicle warning information communicated on said wireless trackside communications system.

2. The warning system of claim 1 wherein said vehicle detector system comprises at least one sensor probe and a control box, said at least one sensor probe positioned within said given area of said railroad crossing for detecting the presence of vehicles therein, said control box coupled to said at least one sensor probe for monitoring said sensor probes to determine whether to send distressed vehicle warning information to said wireless trackside communications system.

3. The warning system of claim 2 wherein said at least one sensor probe uses a magnetic sensing technique to detect the presence of large metal objects.

4. The warning system of claim 3 wherein said at least one sensor probe is buried six to eight feet underground in the railroad crossing.

5. The warning system of claim 4 wherein said at least one sensor probe provides a given coverage range in the railroad crossing.

6. The warning system of claim 5 wherein said given coverage range in the railroad crossing is 40 feet squared.

7. The warning system of claim 2 comprising six sensor probes that provide a given coverage range in the railroad crossing area.

8. The warning system of claim 2 wherein each said sensor probe has an output coupled to said control box.

9. The warning system of claim 1 wherein each trackside device is coupled to the track through a track circuit which detects whether a train is present at a given time.

10. The warning system of claim 9 wherein said train detector system computes a speed on the approaching train through the following steps:

comparing said given time of consecutive trackside device train detections to determine an elapsed time therebetween;

identifying a distance between said consecutive trackside devices; and dividing said distance by said elapsed time between said consecutive trackside devices to determine said approaching train speed.

11. The warning system of claim 10 wherein said display unit comprises a two-sided light emitting diode display for displaying warning messages.

12. The warning system of claim 11 wherein said warning messages include an unsafe vehicle detected in the railroad crossing message, a train approaching message, a train direction message, and a train approaching time message.

13. The warning system of claim 12 wherein said wireless trackside communications system employs a fast message hopping method for communicating said distressed vehicle warning information and said approaching train information.

* * * * *